United States Patent [19]

Placzek

[11] 4,339,204

[45] Jul. 13, 1982

[54] APPARATUS FOR USE IN THE PRODUCTION OF CONCRETE

[76] Inventor: Johann Placzek, 9, Feystrasse, D 894 Memmingen, Fed. Rep. of Germany

[21] Appl. No.: 171,128

[22] Filed: Jul. 22, 1980

[30] Foreign Application Priority Data

Jul. 25, 1979 [DE] Fed. Rep. of Germany ..... 2930154

[51] Int. Cl.[3] ..... B28C 7/04

[52] U.S. Cl. ..... 366/18; 366/39; 366/41; 366/141

[58] Field of Search ..... 366/18, 19, 30, 32, 366/33, 39, 141, 150, 36, 16, 17, 8, 26, 36, 41, 152

[56] References Cited

U.S. PATENT DOCUMENTS

| | | | |
|---|---|---|---|
| 2,687,285 | 8/1954 | Fisher | 366/18 |
| 3,244,411 | 4/1966 | Kuhner | 366/36 |
| 3,343,688 | 9/1967 | Ross | 366/18 |
| 3,379,420 | 4/1968 | Maier | 366/18 |

*Primary Examiner*—Robert W. Jenkins

*Attorney, Agent, or Firm*—Holman & Stern

[57] ABSTRACT

Apparatus for metering and feeding aggregate materials for the production of concrete is constructed so as to be transportable as a unit. To this end, the frame of the apparatus is in two parts which are pivotally connected with one another, the one, fixed, part accommodating metering apparatus, and the other, movable, part accommodating an elevated storage and mixing apparatus. The movable part pivots down into a transporting condition and up into its operating condition. The two frame parts together provide an inclined path for a charge box by which metered quantities of aggregate are transferred from the metering apparatus to the mixing apparatus. Various damping devices are provided for preventing undue vibrations at the start and end of the movement of the charge box.

15 Claims, 12 Drawing Figures

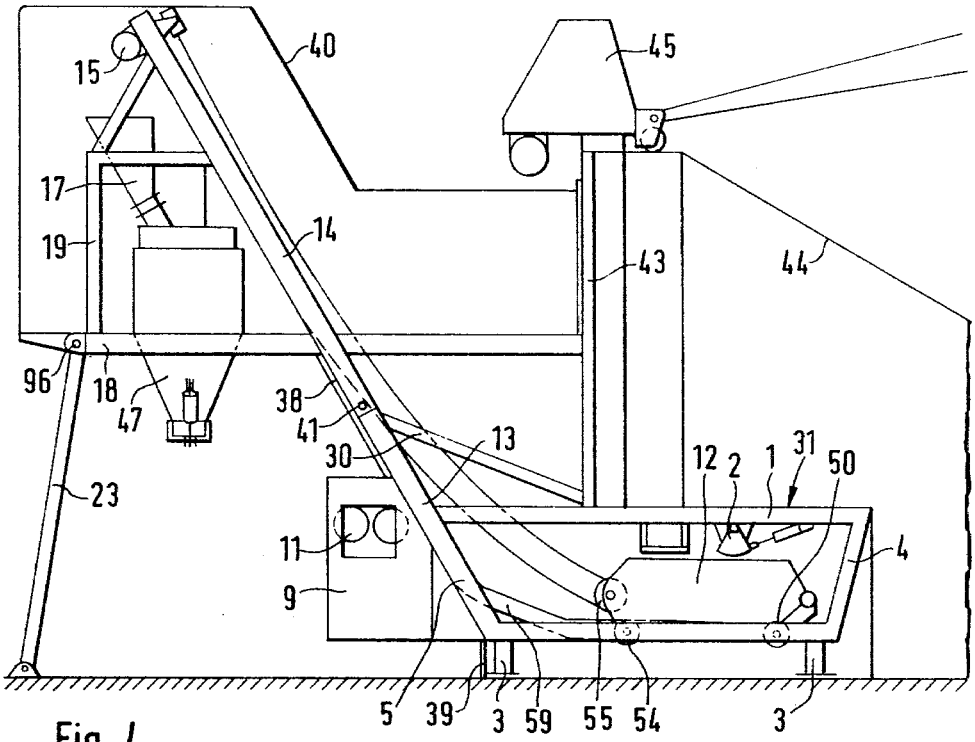
Fig. 4
Fig. 11
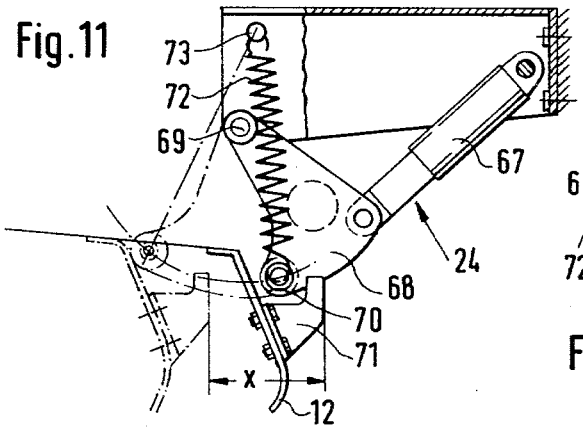
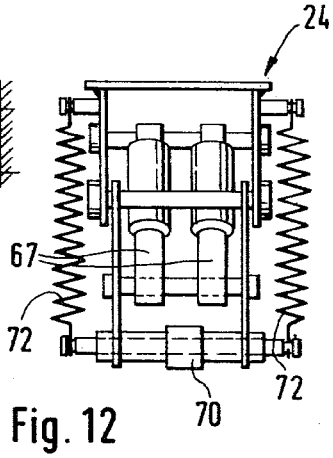
Fig. 12

APPARATUS FOR USE IN THE PRODUCTION OF CONCRETE

BACKGROUND OF THE INVENTION

This invention is concerned with apparatus for use in the production of concrete, more particularly with apparatus, transportable as a unit, for metering and feeding aggregate materials for the production of concrete, such apparatus comprising a frame which can be converted from an operating condition into a condition in which it can be transported (transporting condition).

Apparatus of the foregoing type should be constructed in such a manner that it can readily be transported by road. The width must therefore not exceed 2.5 meters (10 feet), and in addition its length and height should be within acceptable limits. Furthermore, the weight should not render removal and transportation more difficult, and the general construction should be such as to enable the apparatus to be dismantled and assembled quickly. In addition to the foregoing requirements, which are concerned with the ability of the apparatus to be transported, a high output when metering is also required in order to achieve a high mixing output of the mixing apparatus, which is also incorporated into the apparatus.

BRIEF SUMMARY OF THE INVENTION

The invention thus provides an apparatus, transportable as a unit, for metering and feeding aggregate materials for the production of concrete, said apparatus comprising a frame, which serves at least partly as a support arrangement for storage containers for the aggregate materials and which accommodates a metering apparatus and a feed apparatus together with an elevated storage and mixing apparatus, wherein the frame consists substantially of two parts, one of which accommodates the metering apparatus and the other the elevated storage and mixing apparatus, said two frame parts being pivotally connected with one another whereby said other part can be folded relative to said one part, thereby enabling the apparatus to be converted from an operating condition into a transporting condition. The feed apparatus comprises a charge box movable by means of a winch or the like along an inclined path, which path is provided by the two frame parts. The charge box path may comprise three sections, viz. a lower, slightly inclined, section in which the charge box is disposed in a metering condition, a main section which has an inclination of about 60°, and an intermediate section which connects the lower and main sections and has an inclination of about 20°. The main section, furthermore, may incorporate the pivot point by which the two frame parts are connected. The charge box has a low profile and is substantially rectangular in outline; its inclination is determined by the charge box path.

Since the frame, which accommodates all the essential parts of the invention, comprises only two parts, it is possible to quickly convert the apparatus from its transporting condition to its operating condition and vice versa. The charge box used allows a very compact construction so that the lengthwise dimensions remain within moderate limits. The space requirement is small, and in particular it is possible to make do without a pit and yet to have a very large carrying capacity for the storage containers for the aggregate materials. The arrangement of the charge box path favours this compact construction, but avoids the heavy charge box excessively stressing the metering apparatus, and especially a balance device thereof, during the downward movement of the box. During the lifting operation, favourable ratios arise so that a charge box winch of simple construction and relatively low performance can be used. Again, the large charge box allows the individual granular materals to be metered directly into the charge box, which thus gives rise to a small drop-height.

In all, very short metering times and a small time period for the operation of the charge box are achieved.

Further features of the invention are to be found set out in the appendant claims. These further features, especially various damping devices used, further allow the output capability to be increased without additional strain on the apparatus.

BRIEF DESCRIPTION OF THE DRAWINGS

The various objects and advantages of the present invention will become more apparent from the following detailed description, to be read with reference to the accompanying drawings, in which:

FIG. 4 is a side view of a modified apparatus in accordance with the invention;

FIG. 11 is a fragmentary view showing details of an approach movement damping device for the charge box as it moves into its weighing position; and FIG. 12 is a side view of the device shown in FIG. 11.

DESCRIPTION OF THE PREFERRED EMBODIMENTS

Figure 1:
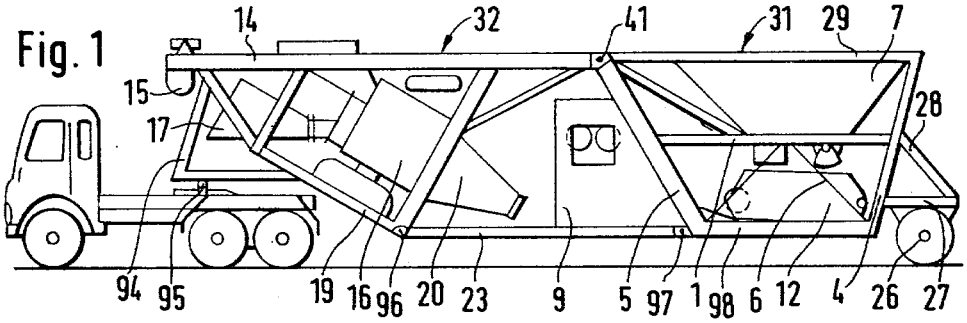
FIG. 1 shows a side elevation view illustrates the transporting conditions of an apparatus in accordance with the invention.

The frame, which accommodates all the essential parts of the apparatus in accordance with the invention, comprises two frame parts 31,32 which, as can clearly be seen in FIG. 1, are connected with one another by a hinge 41 and by a tie-bar 23. The tie-bar 23 engages the frame parts 32,31 with its ends, respectively at 96,97. Generally, one such tie-bar 23 is disposed at each side of the frame; this will not be mentioned in detail in the following description.

The frame part 31 accommodates all the essential parts of the metering apparatus. This frame part 31 is in the shape of a trapezium and consists essentially of the frame sections 29, 98, which are arranged parallel to one another, and frame sections 4,5, which are inclined. For transporting purposes, the frame section 4 is connected to support struts 27,28 for the wheel axle 26. The frame part 31 accommodates fixed separating walls 7 for the storage containers which are to be formed for the aggregate materials, and also a base plate in which metering flaps 2 are arranged.

Figure 2:
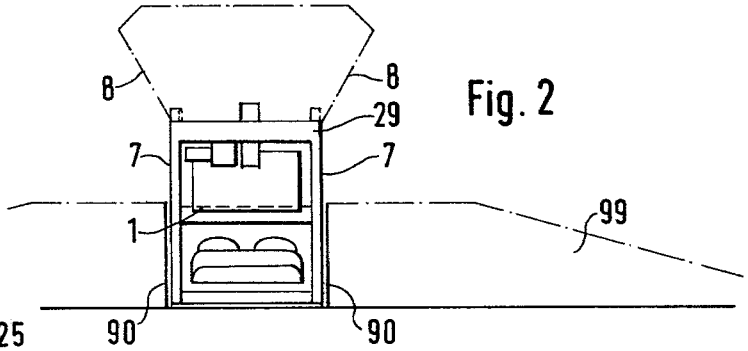
FIG. 2 is a view from an end of the apparatus of FIG. 1, when it is erected on the ground and has containers partly set up for constituting the storage containers for the aggregate materials.
Figure 3:
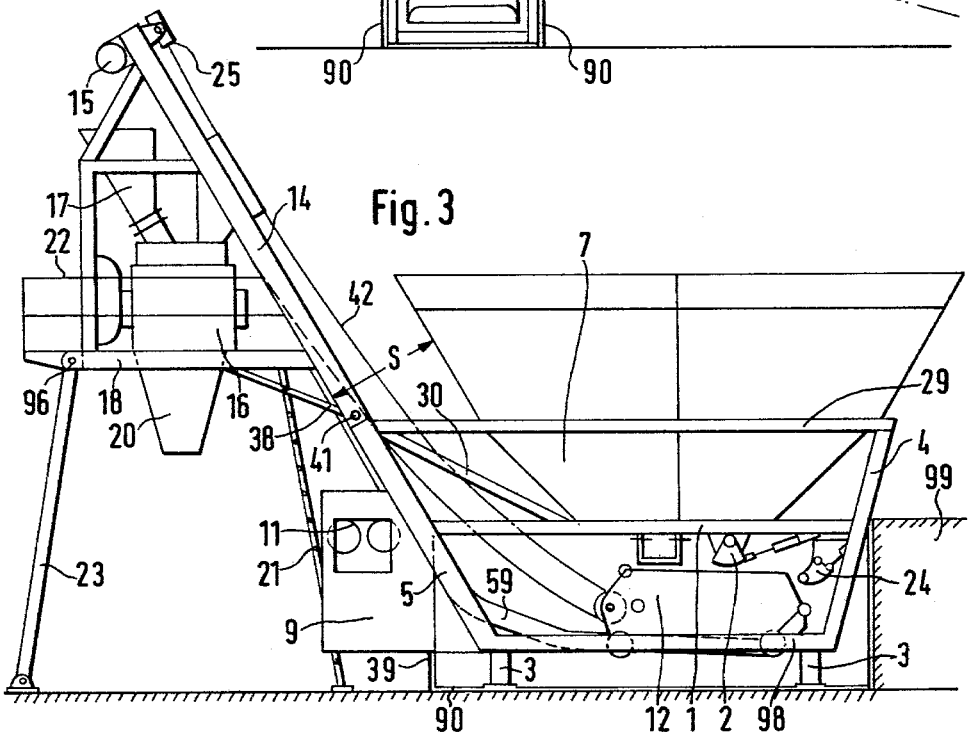
FIG. 3 is a side view of the apparatus of FIG. 1, in an operating condition.

As can be seen in FIGS. 2 and 3, the storage containers for the aggregate materials are enlarged by detachable walls 8.

In the transporting condition, which is shown in FIG. 1, the frame part 32 is inclined in such a manner that the upper part of a charge box lift path constituted thereby assumes a more or less horizontal condition. In the operating condition (FIG. 3), the upper part 14 of the lift path, which part guides the charge box, forms an extension of the frame section 5.

For transporting purposes, the frame section 19 of the frame part 32 is provided with supports 94 to which a swivel coupling 95 is secured, so that altogether a unit of the articulated type is formed.

In the operating condition, which is shown in FIG. 3, as already indicated previously, the frame part 32 is swung up and is supported by the tie-bar 23, which now acts as a prop.

In the embodiment shown in FIGS. 1 and 3, the frame part 32 accommodates the mixer 16, which rests on the frame sections 18 20 indicates a transfer hopper, by which the mixed material is dispensed into transport vehicles, e.g. ready-mix lorries, while 22 indicates a protective rail which is additionally attached in the operating condition and 17 indicates a weighing machine for cement, which machine is fixedly incorporated.

All the control elements of the metering apparatus in the frame part 31 are assembled at a control station 9, notably indicator heads 11 for the aggregate materials. Also the control elements for the mixer, a water supply (not shown in detail) and the cement weighing machine can be incorporated into the control station. The control station is so positioned as to make use of available space during transportion, while being advantageously positioned in the operating condition.

In the operating condition, furthermore, the frame part 31 is mounted on supports 3. A ladder 21 completes the operating condition.

A strut 30 serves as additional strengthening for the frame part 31. A similar task is performed by supports 6 (shown in FIG. 1, but omitted from the other drawings for the sake of clarity).

The charge box 12 is shown in its metering position in FIG. 3. In this position it is disposed beneath the metering flaps.

The path of the charge box comprises several sections. The lower section, in which the charge box is shown in FIG. 3, is slightly inclined and is concealed by the frame sections 98. Adjacent this section is an intermediate section 59, which is inclined at about 20° and has the task of facilitating the withdrawal of the charge box from beneath the metering flaps and of creating a transition to the section of the charge box path which consists of the parts 13,14 and is inclined at about 60°. On the other hand, the section 59 reduces the speed of the charge box as it moves down the path, so that the charge box runs on to the lowermost section at a moderate speed.

For moving the charge box along its path, a cable 42 is provided driven by a winch 15. The cable runs from the winch to a pulley 55 on the charge box and from there back to a device 25 (to be hereinafter described in detail) for damping the starting motion, 24 indicates a further damping device which has the task of damping the downward movement of the charge box in order that the metering apparatus and in particular the weighing machine is strained as little as possible. Further details are shown in FIGS. 11 and 12 and will be described hereinafter in detail.

The modified embodiment of FIG. 4 is distinguished from that of FIG. 3 essentially in that the mixer 16 together with the hopper 20 is replaced by a storage device 47, such an arrangement being utilised when the aggregate and cement are to be metered dry, e.g. for supply into a ready-mix lorry, in which the mixing operation can then take place.

While the embodiment shown in FIG. 2 indicates that the sides 99 can be built up by means of shutters 90, thus to allow access with bucket loaders for filling the storage containers, the embodiment of FIG. 4 provides for the utilization of star-shaped boxes which are partitioned by separating walls 44, a scraper device 45 being arranged on the wall 43 for feeding the aggregate materials, in a manner known per se, to the center of the star-shaped storage containers. FIG. 4 further shows that external walls 38, 39, 40 can be attached, if desired. The frame part 31 is likewise in the form of a trapezium in the embodiment of FIG. 4; the frame section 29, however, is omitted.

Figure 5:
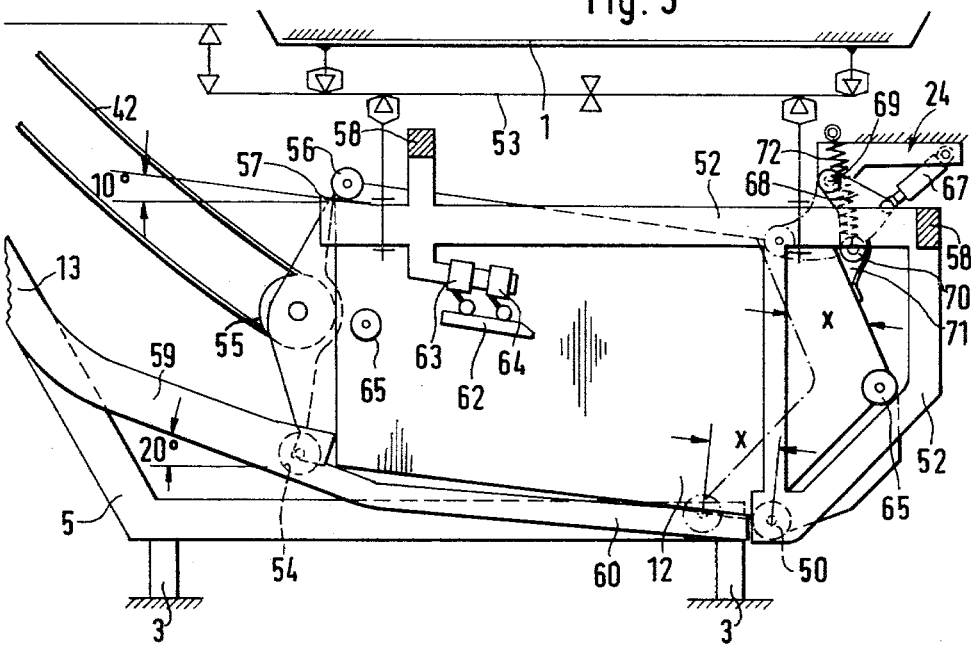
FIG. 5 is a fragmentary side view, showing details of a charge box in its weighing position.
Figure 6:
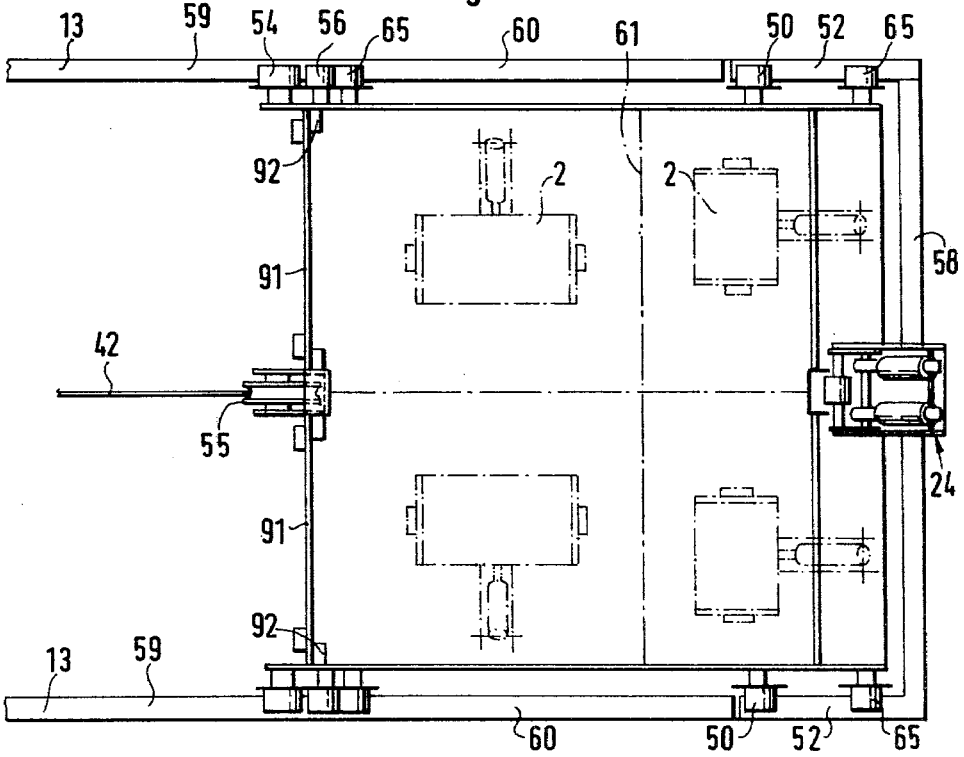
FIG. 6 is a plan view of the details shown in FIG. 5.

FIGS. 5 and 6 show essential parts of the weighing machine and the metering apparatus. The charge box 12, which may have a construction as described in German Offenlengungschrift No. 25 03 301, is disposed in its metering position (weighing position) in FIG. 5. Thus it is located in the region of the lower section 60 of the charge box path. For supporting the charge box, two pairs of support rollers 50,54 are provided, one pair 50 being carried by an auxiliary frame 52 for the weighing balance. The two frame parts 31,32 are connected with one another at both sides of the charge box 12 by frame sections 58.

On the charge box, furthermore, there is provided an additional pair of support rollers 56, which run on a rail portion 57 of the auxiliary frame 52, thus also relieving the load on the pair of rollers 54. The charge box is thus suspended in the auxiliary frame 52 by means of the rollers 50,56. The auxiliary frame, is connected, in a manner known per se, with corresponding parts of the balance 53, as shown schematically in FIG. 5. The charge box is filled through the metering flaps 2, which are shown in FIG. 6 but not in FIG. 5. The chain-dot lines 61 indicate the partitioning of the storage containers for the aggregate materials.

When the charge box moves into the position of FIG. 5, it comes about that the charge box first moves from the section 13 to the section 59, which is substantially flatter than the section 13. This reduces greatly the downward speed of the charge box. When the front rollers 50 reach the end of the section 60, the skid 62 attached at the side of the charge box first actuates the switch 63, which switches off the charge box winch 15. The movement of the charge box will continue, however, because of its kinetic energy, so that the charge box runs completely into the position, shown in FIG. 5 in the auxiliary frame 52. When this position is reached, the switch 64 is actuated, which initiates the metering operation.

While the section 59 has an inclination of about 20°, the inclination of the section 60 is less, being about 5°.

The front wall of the charge box 12 is, as can be seen in FIG. 6, formed by flaps which are movable about hinges 92 so that, e.g. for calibrating the balance, the inside of the charge box is also accessible in its lowermost position.

When the charge box moves into its metering (weighing) position, the charge box actuates the damping device 24, details of which can be seen in FIGS. 11 and 12. The damping device comprises essentially a swinging arm 68 which is movable about the pivot 69 and is acted upon by the spring 72 and two dynamic dampers 67. The dampers 67 have in particular a form such as is known in lorries. By fixing the springs 72 at the point 73, two positions result for the swinging arm 68.

At the end of its downward movement the charge box 12 strikes with its front part against the roller 70 on the swinging arm 68 and moves the latter therewith. Over the path portion marked "X" the movement of the charge box 12 is brought to rest. The arrangement of the spring 72 leads to the roller 70 being raised from the stationary charge box 12, so that the movement of the charge box is not interferred with during the weighing operation.

On the front wall of the charge box there is arranged a latch 71 movable with the charge box and operable upon upward movement of the charge box. This charge box latch 71 re-positions the swinging arm 68 in its initial position when the upward movement is initiated.

Figure 7:
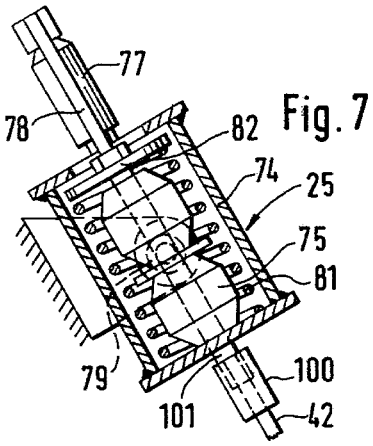
FIG. 7 is a section view of a starting motion damping device.
Figure 8:
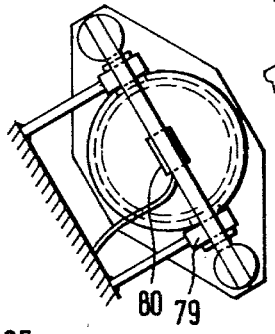
FIGS. 8 and 9 are further views of the device shown in FIG. 7.
Figure 9:
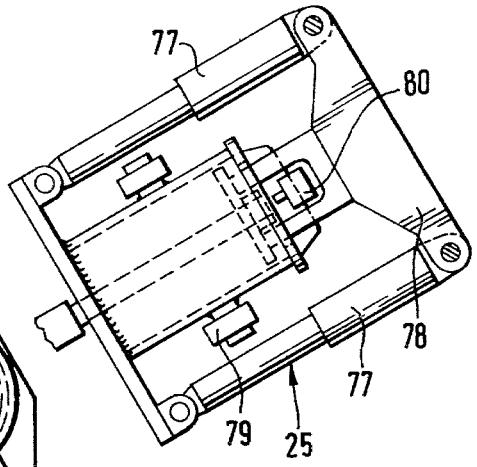

In the apparatus in accordance with the invention not only is the end of the downward movement of the charge box damped, but also for the starting motion there is provided a starting motion damping device 25, details of which can be seen in FIGS. 7 and 9. The starting motion damping device comprises a housing 74 in which the springs 75, in the form of rubber buffers, are disposed. The draw-cable 42 is connected by means of a socket-joint 100 with a draw-rod 101 the upper end of which carries a plate 82 which is connected to a yoke 78 arranged outside the housing 74. When drawing tension is applied to the cable 42, therefore, the rubber springs 75 and also the hydraulic dampers 77 are compressed. The start impact is thus greatly reduced and the dampers 77, which can be e.g. shock absorbers of lorries, suppress any vibrations. The whole housing 74 is journalled for movement about the hinge 79 at the upper end of the lift path 14. Between the housing 74 and the yoke 78 there is arranged a further switch 80 which is connected with a timer relay, so that the winch 15 is switched off when a strong resistance arises in the lifting operation, which resistance leads to a strong lasting compression of the springs. The rubber springs 75 are backed up by a spring 81.

Figure 10:
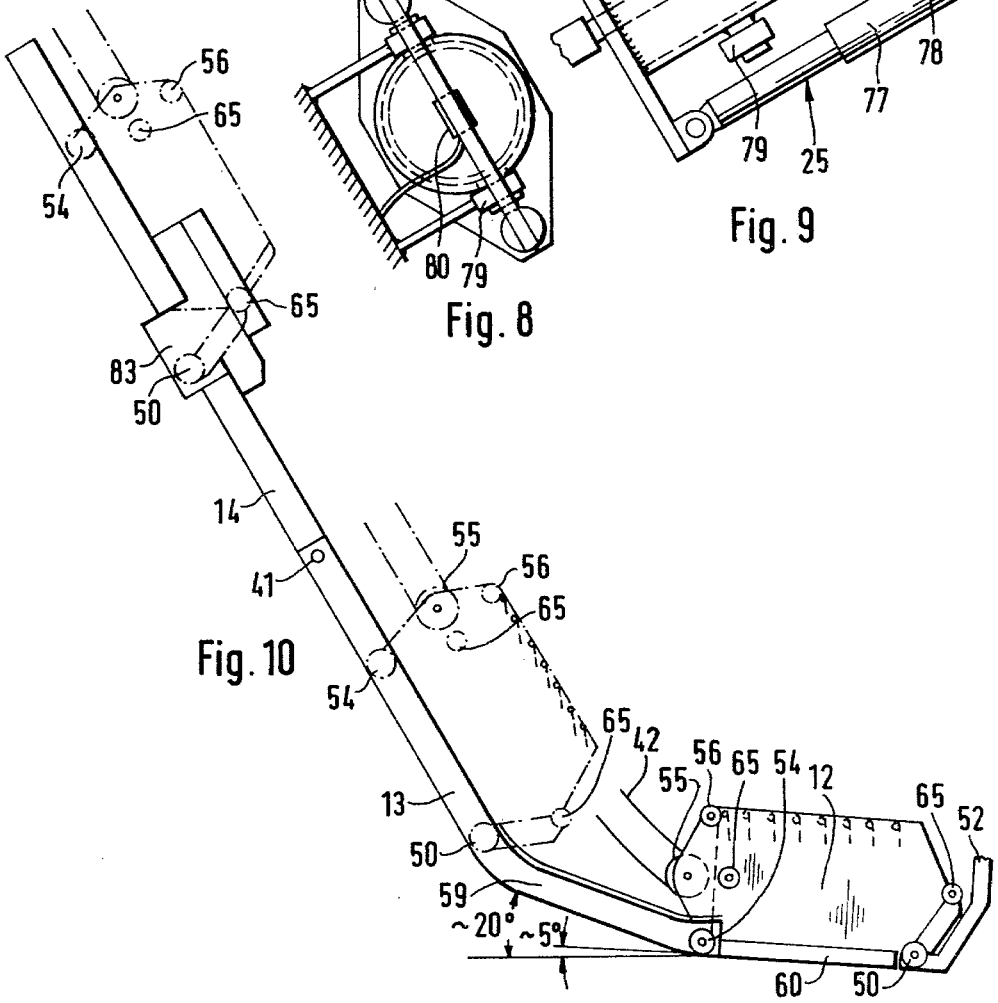
FIG. 10 is a fragmentary view of the charge box and its lift path.

FIG. 10 shows the lift path and the movement of the charge box 12. In the lowermost position the charge box is disposed in the filling (metering) position. The charge box has only a slight inclination. When the lifting pull is initiated, the charge box moves from the section 60 to the section 59 into a certain inclined position which facilitates the withdrawal of the charge box from beneath the metering flaps and also improves the starting motion. Adjacent the section 59 of the lift path are the sections 13 and 14. In the section 14 is arranged a gap 83 which enables the rollers 50 to be lowered, whereby the emptying flap of the charge box is opened, in a manner known with charge boxes of this construction. The auxiliary rollers 65 on the charge box prevent the rollers 54 from dropping into the gap, and the end of the charge box from falling during the emptying operation.

After the charge box has been emptied, the downward movement takes place, and this movement can be performed relatively quickly.

In this connection it is important that the dimension (indicated by "S" in FIG. 3) for the passage of the charge box can be kept small. In this way the overall dimensions of the construction are reduced despite the considerable volume of the charge box.

In practice it has been found that the height of the hinge 41 should be selected at about 3.10 meters (approx. 12 feet) above ground level. The height during transportation by road then does not exceed the amount of 4 meters (approx. 16 feet) and also it will provide a moderate overall length.

I claim:

1. Apparatus, transportable as a unit, for metering and feeding aggregate materials for the production of concrete, said apparatus comprising a frame, which serves at least partly as a support arrangement for storage containers for the aggregate materials and which accommodates a metering apparatus and a feed apparatus together with a storage and mixing apparatus in both a transporting and elevated operating position, wherein the frame comprises two parts, one of which supports the metering apparatus and the other of which supports the storage and mixing apparatus in both said transporting and elevated positions, pivot means for pivotally connecting said two frame parts with one another whereby said other part can be moved about said pivot means relative to said one part, thereby enabling the apparatus to be converted from said elevated operating position into a transporting position and a transporting position to an operating position, and a tie-bar connecting said two parts together in said transporting position to mutually brace said parts thereby, and wherein the feed apparatus comprises a charge box which is movable along an inclined path, which path is provided by said two frame parts.

2. Apparatus according to claim 1, wherein said inclined path comprises three sections, viz. a lower, slightly inclined, section in which the charge box is disposed in a metering position, a main section which has an inclination of about 60°, and an intermediate section which connects the lower and main sections and has an inclination of about 20°.

3. Apparatus according to claim 2, wherein said main section of said inclined path incorporates the pivot point of said pivot means by which the two frame parts are connected.

4. Apparatus according to claim 1, wherein the charge box has a low profile and is substantially rectangular in outline.

5. Apparatus according to claim 1, wherein said tie-bar is pivotally connected at one end to said other part and removably connected at the other end to said one part so that said tie-bar may be disconnected from said one part and used, to provide a support for said other part in the elevated operating position.

6. Apparatus according to claim 1, wherein said one frame part accommodating the metering apparatus comprises a control station, which includes indicator devices for the metering apparatus, said station being arranged in the space beneath the pivot point of said pivot means for the two frame parts.

7. Apparatus according to claim 1, wherein said one frame part accommodating the metering apparatus has in side elevation an upwardly widening trapezium shape, a rear section of said one frame part being connected with a rear axle of a transportation means for transportation purposes.

8. Apparatus according to claim 1, wherein said other frame part is movable about said pivot means down through about 60° from the elevated operating position into the transporting position, so that an upper part of said inclined path is disposed horizontally in the transporting condition.

9. Apparatus according to claim 1, wherein there is provided on said one frame part a damping means against which the charge box engages at the end of its movement at the lower end of said inclined path.

10. Apparatus according to claim 9, wherein said damping means comprises a swinging arm pivotally mounted on said one frame part, at least one dynamic damper operably mounted between said one frame part and said arm to dampen the movement of said arm, means to move said arm after the damping action into a position in which it no longer is in contact with the charge box, and a latch member mounted on the charge box to operably engage the swinging arm as it moves off of the lower end of said inclined path to return said arm to its damping position.

11. Apparatus according to claim 1, wherein there are connected with said one frame part two switches, which are actuated by a switching cam on the charge box, one of said switches being effective to switch off the drive of the charge box during the downward movement of the latter, and the other of said switches initiating operation of the metering apparatus,

12. Apparatus according to claim 11, wherein a winch means is provided operatively connected to said charge box to drive the charge box.

13. Apparatus according to claim 12, wherein the winch is operatively connected with the charge box by means of a cable, at one end of which is provided a starting motion damping device.

14. Apparatus according to claim 13 wherein the starting motion damping device comprises a spring together with a dynamic damper which suppresses vibrations in the spring.

15. Apparatus according to claim 1, wherein said metering apparatus comprises at least one opening at the bottom of said storage container, adjustable metering flaps mounted at said opening to control the flow of said aggregate materials therethrough, and a weighing balance.

* * * * *